United States Patent [19]

Gahrs

[11] 4,097,077

[45] Jun. 27, 1978

[54] CLOSURE LATCH

[75] Inventor: James S. Gahrs, Cupertino, Calif.

[73] Assignee: General Motors Corporation, Detroit, Mich.

[21] Appl. No.: 739,101

[22] Filed: Nov. 5, 1976

[51] Int. Cl.[2] ..... E05C 3/26

[52] U.S. Cl. ..... 292/216; 292/DIG. 26

[58] Field of Search ..... 292/216, 280, DIG. 24, 292/DIG. 25, DIG. 26

[56] References Cited

U.S. PATENT DOCUMENTS

| | | | |
|---|---|---|---|
| 2,782,062 | 2/1957 | Smith | 292/DIG. 27 |
| 3,695,663 | 10/1972 | Cockburn | 292/DIG. 26 |
| 3,999,791 | 12/1976 | Torii | 292/216 |

*Primary Examiner*—Richard E. Moore
*Attorney, Agent, or Firm*—Charles E. Leahy

[57] ABSTRACT

A closure latch includes a ring member connecting the lock operating lever and slidably engaged over an angularly inclined portion of the rod connecting the inside remote handle and the latch operating lever. Initiation of actuation of the inside remote handle shifts the rod and causes the ring to be translated to move the locking lever from its locked position to its unlocked position. Continued actuating movement of the inside remote handle unlatches the door. Thus, the closure latch is unlocked and unlatched by a single actuation of the inside handle rather than by the sequential and separate lifting of a lock button followed by actuation of the inside handle.

3 Claims, 6 Drawing Figures

CLOSURE LATCH

The invention relates to improvements in vehicle body door closure latches of the type having a locking lever for selectively coupling and uncoupling an operating member from a detent for a latch bolt.

U.S. Pat. No. 3,695,663 by Stanley D. Cockburn describes a commercially successful closure latch. The closure latch is mounted on the door and includes a bolt movable between latched and unlatched positions relative a body mounted striker pin. A detent for the bolt is pivotally mounted for movement between detenting and undetenting positions relative the bolt. An operating lever for operating the detent between the detenting and undetenting positions relative the bolt is operably connected to an inside handle and an outside handle so that either handle may be actuated to effect unlatching of the closure latch. The connection between the operating lever and the detent is made by an intermittent lever which is movable between a position operably engaging the detent and another position bypassing the detent so that the operating lever is uncoupled from the detent and the closure latch will not be unlatched even though the inside handle or outside handle is actuated. A locking lever is provided for shifing the intermittent lever between its engaging position and bypassing position. The locking lever may be operated by an inside door lock button or an outside key cylinder assembly.

In Cockburn, the locking lever must be returned to its locking position establishing engagement between the intermittent lever and detent prior to unlatching of the closure latch by the outside handle. This sequence is desirable because vehicle security against unauthorized entry is obtained by uncoupling the operating lever until the key cylinder assembly is unlocked by a properly bitted key. With respect to unlocking the closure latch from inside the vehicle, the closure latch of Cockburn prevents inadvertent unlatching of the door because it requires the sequential steps of lifting of the door lock button to unlock the closure latch and then actuating the inside handle to unlatch the closure latch.

However, there are certain vehicle applications wherein the sequential lifting of the inside door lock button and actuation of the inside handle would be disadvantageous. For example, in police and similar emergency vehicles, it may be desirable to unlock and unlatch the door without two separate and sequential steps. Accordingly, it is desirable to offer a simple and effective modification to the Cockburn closure latch whereby an inside lock button will be automatically lifted upon actuation of the inside handle.

According to the present invention, a ring member is connected to the locking lever and slidably engaged over an angularly inclined portion of the rod which connects the inside remote handle to the operating lever. Actuation of the inside remote handle shifts the rod and causes the ring to be translated on the rod and moved vertically, thus effecting movement of the locking lever from its locked position to its unlocked position to thereby establish coupling of the operating lever to the detent by the intermittent lever. Continued actuating movement of the inside remote handle will cause the operating lever and intermittent lever to move the detent to undetenting position which releases the bolt and unlatches the door. Thus, the closure latch is unlocked and unlatched by a single actuation of the inside handle.

These and other features, objects and advantages of the invention will become apparent upon consideration of the specification and the appended drawings in which.

Figure 1:
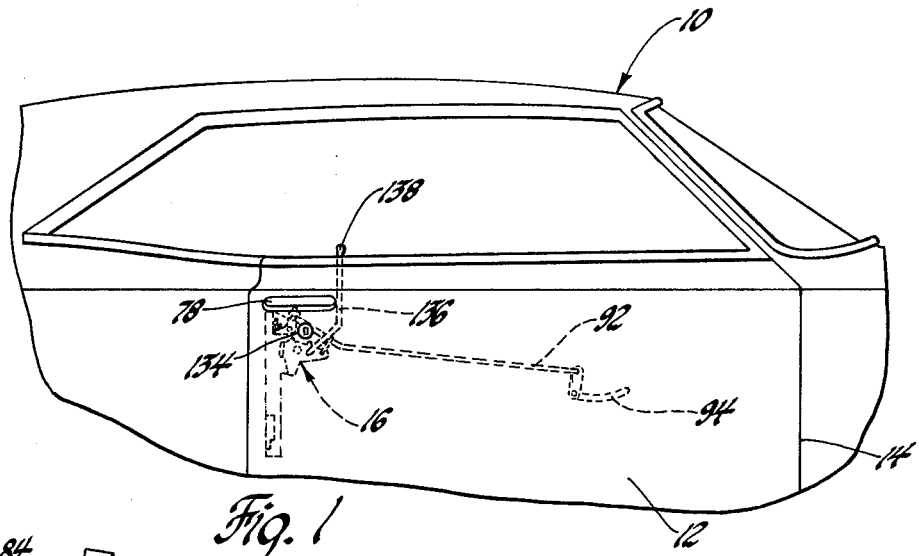
FIG. 1 is a partial view of a vehicle body embodying a closure latch according to the invention.

Referring to FIG. 1 of the drawings, a vehicle body designated generally 10 includes a front door 12 hinged at its forward edge 14 to the body 10 for movement between a closed position as shown and an open position, not shown. A door lock 16 according to this invention is mounted on the interior of the rear wall of door 12 for engagement with a conventional cooperating headed striker pin, not shown, on the adjacent lock pillar wall of the rear quarter structure of the body to hold the door 12 in closed position.

Figure 5:
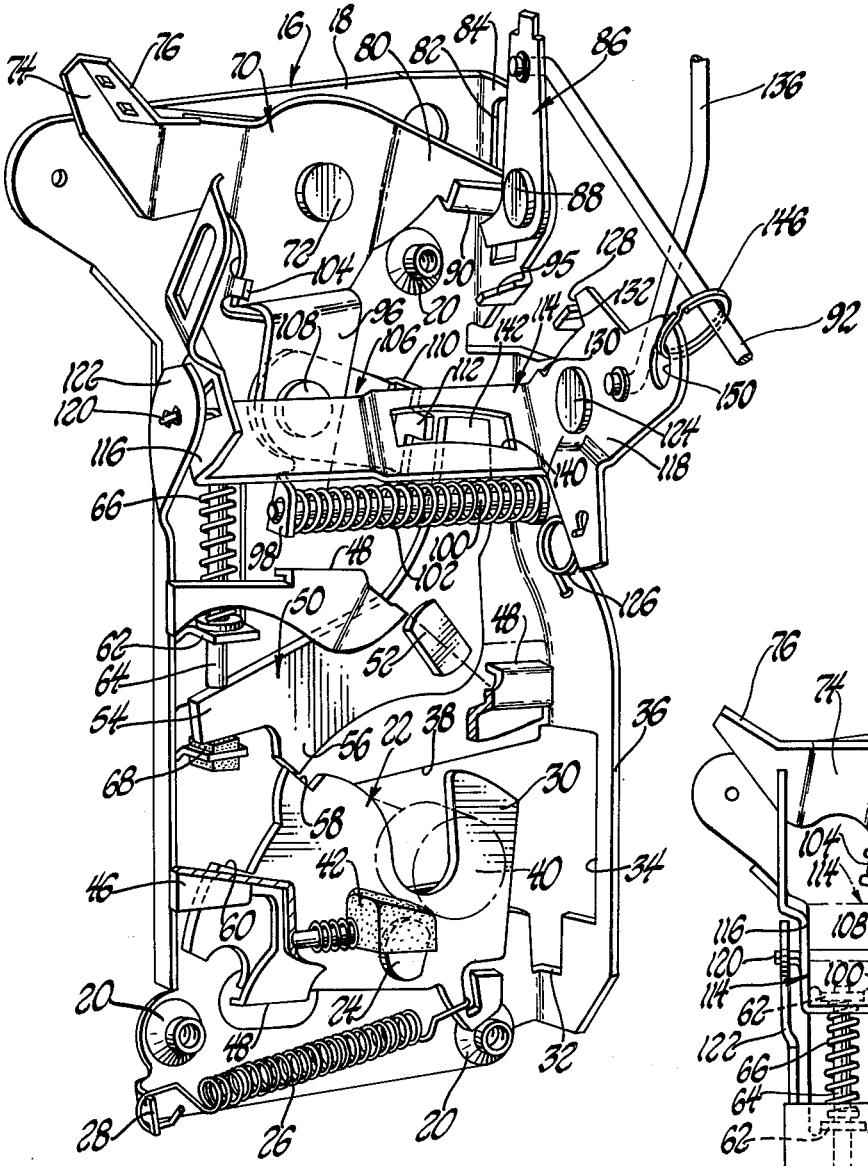
FIG. 5 is an enlarged perspective view of the closure latch.
Figure 6:
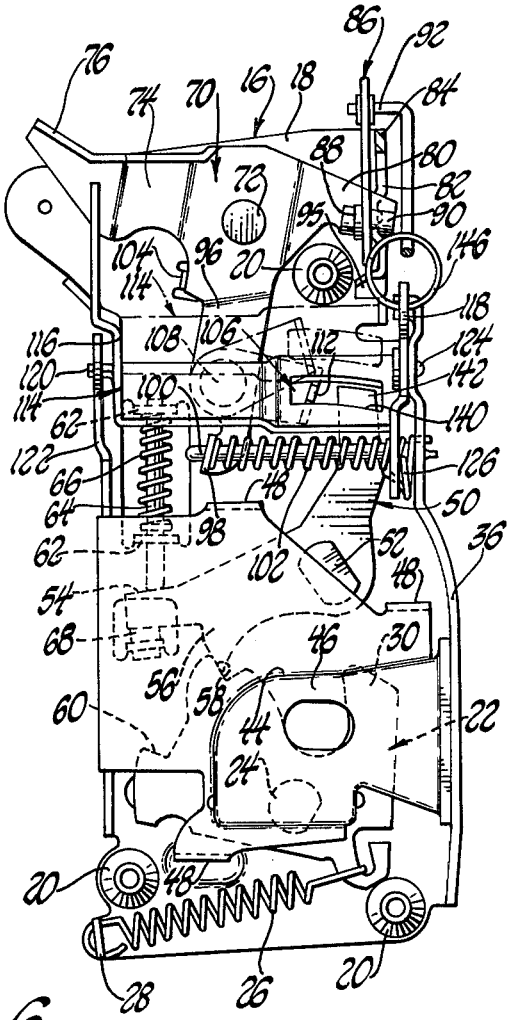
FIG. 6 is a frontal elevational view of the closure latch.

As shown in FIGS. 5 and 6, the lock 16 includes a main frame 18 having a plurality of threaded embossments 20 which receive bolts, not shown, extending through the lock pillar wall of door 12 to thereby mount the frame 18 on the interior of such wall. An inverted fork-type bolt 22 is pivoted at 24 to the frame 18 for movement between latched position, as shown, and unlatched position as will be described. A coil tension spring 26 hooked between the bolt 22 and a notched lateral tab 28 of the frame 18 continually biases the bolt clockwise to unlatched position. The bolt is located in unlatched position by the engagement of the outboard leg 30 thereof with an edge 32 of a stepped cutout 34 in a lateral side flange 36 of frame 18. The cutout 34 merges into a generally U-shaped cutout 38 in frame 18 which is aligned with a like cutout in the lock pillar wall of door 12 to provide for entrance of the head and shank of a conventional striker pin, shown in phantom lines at 40 in FIG. 5, into the frame 18 for cooperation with the bolt. When the bolt is in latched position as shown, the shank of the striker pin is received within the bolt throat and the head of the striker pin is received between a conventional slidable shoe 42 and an upper ramp 44, FIG. 6, of an auxiliary frame 46. Frame 46 includes a plurality of lateral tabs 48 which are staked to the frame 18 to secure the frame 46 thereto in spaced relationship.

A detent 50 is pivoted at 52 to the frame 18 and includes an arm 54 having a foot 56. Foot 56 is engageable with either a shoulder 58 or a shoulder 60 of the bolt 22 to thereby respectively maintain the bolt in either fully latched position as shown or secondary latched position, clockwise of the position shown. The frame 18 is shown in FIGS. 5 and 6 as including a spaced pair of lanced apertured lateral tabs 62 which receive an intermediately flanged pin 64 therethrough. A coil compression spring 66 surrounds the pin 64 and seats between the upper tab 62 and the flange of the pin to thereby bias the pin downwardly and into engagement with the arm 54 of detent 50. This in turn biases the arm 54 into engagement with a rubber bumper 68 conventionally secured to a lanced lateral tab of the frame 18 to thereby locate the detent 50 in detented position as shown and resist clockwise movement thereof to undetented position wherein the foot 56 of the detent is moved out of engagement with either shoulder 58 or 60 to permit bolt 22 to move to unlatched position.

An operating lever 70 is intermediately pivoted to 72 to the frame 18. One arm 74 of the lever includes a lateral tab 76 which is adapted to be engaged by a vertical push rod, not shown, of a conventional outside pull-type handle 78, FIG. 1, for movement of the lever 70 counterclockwise of the pivot 72 upon operation of the handle. The other arm 80 of the lever extends outwardly through a vertical slot 82 in a lateral side flange 84 of the frame 18. A remote bellcrank lever 86 is pivoted at 88 to the flange 84 and is engageable with a return bent flange 90 of arm 80 to thereby swing the lever 70 counterclockwise of the pivot 72. Lever 86 is conventionally connected by a rod 92, FIG. 1, with an inside remote handle 94, mounted on the inner panel of door 12. Counterclockwise movement of the lever is controlled by a tab 95 of frame 18.

As best shown in FIG. 5, a depending offset arm 96 of the lever 70 includes a lateral apertured tab 98. An intermediately flanged pin 100 extends through the tab 98 and an aperture in the flange 36 and a coil compression spring 102 seats between the tab 98 and the flange of the pin to continually bias the lever 70 clockwise of the pivot 72. The lever is located against the bias of the spring 102 by the engagement of the arm 96 with a lateral lanced tab 104 of the frame 18.

An intermittent member 106 is pivoted at 108 to the arm 96 of lever 70 and includes a lateral tab 110 having an extension 112.

A locking lever 114 includes lateral flanges 116 and 118. A lanced lateral tab 120 of flange 116 is received within a generally hourglass-shaped opening, FIG. 6, in a flange 122 of frame 18 and flange 118 is coaxially pivoted at 124 to the flange 36 to thereby pivotally mount the locking lever on the frame for movement between an unlocked position, shown in FIG. 5 and in full lines in FIG. 6, and a phantom line indicated locked position of FIG. 6. A coil overcenter type torsion spring 126 hooked between flanges 36 and 118 selectively and alternately biases the locking lever to either position. The locking lever is respectively located in unlocked and locked positions by the engagement of a shoulder 128 or 130 of flange 118 with a lateral tab 132 of flange 36. The flange 116 of the locking lever is conventionally connected to an outside conventional key cylinder assembly 134, FIG. 1, and the flange 118 of the locking lever is conventionally connected by a rod 136, FIG. 1, with an inside door lock button 138. The locking lever further includes a generally arcuate slot 140 which receives the tab extension 112 therethrough at all times. When the lever is in unlocked position, slot 140 generally follows a path proscribed about the detent pivot 52.

The detent 50 includes an upwardly extending arm 142 which lies in the path of the tab 110 of the intermittent member 106 when the locking lever 114 is in the unlocked position as shown in FIG. 5. Thus, upon counterclockwise movement of the lever 70 by either the handle 78 or the remote handle 94, the engagement of the tab 110 with the detent arm 142 will move the detent 50 clockwise of pivot 52 to undetented position and permit movement of the bolt 22 to unlatched position.

Should either the outside key cylinder assembly 134 be operated or the door lock button 138 depressed to move the locking lever to its phantom line indicated locked position of FIG. 6, the engagement of the lower edge of slot 140 with tab extension 112 will swing the intermittent member 106 counterclockwise of pivot 108 to its phantom line indicated position of FIG. 6. Tab 110 will now bypass the detent arm 142 should lever 70 be moved counterclockwise of pivot 72. Thus, the operating lever 70 is uncoupled from the detent 50.

Since the arcuate shape of the slot 140 is proscribed about the pivot 52 when lever 114 is in unlocked position, the intermittent member 106 is slightly rotated about the pivot 108 as it is translated by the lever 70. This ensures full engagement of the tab 110 with the detent arm 142 when the detent is released.

When the bolt 22 is in unlatched position, the detent foot 56 rests on the edge of the bolt counterclockwise of the shoulder 60. Should the locking lever 114 be moved to locked position when the bolt is in unlatched position, subsequent closing movement of the door will rotate the bolt to either intermediate or fully latched position as the detent 50 swings intermittently about the pivot 52. The locking lever remains in its locked position.

Figure 2:
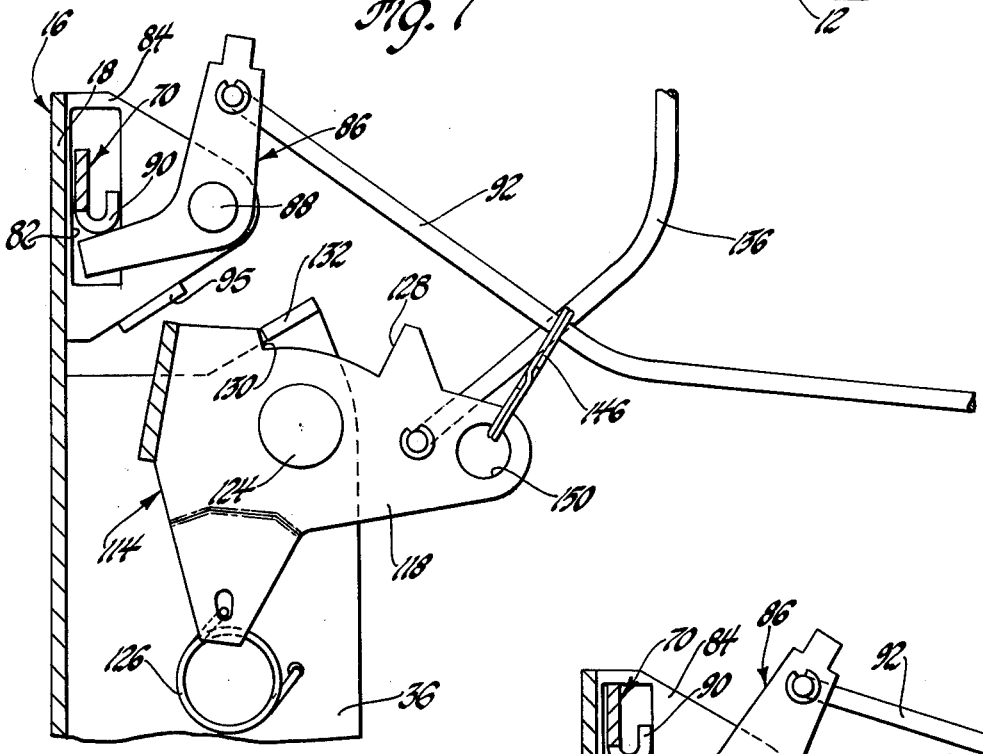
FIG. 2 is an enlarged partial view of the closure latch having parts broken away and in section and showing the closure latch in its locked condition.

Referring now to FIGS. 2 and 5, it will be seen that the locking lever 114 is in its locked position wherein the intermittent member 106 has been swung counterclockwise of its pivot so that tab 110 of operating lever 70 will miss the detent arm 142 should the lever 70 be moved counterclockwise as by operation of the outside pull handle 78 or operation of the inside remote handle 94.

Figure 3:
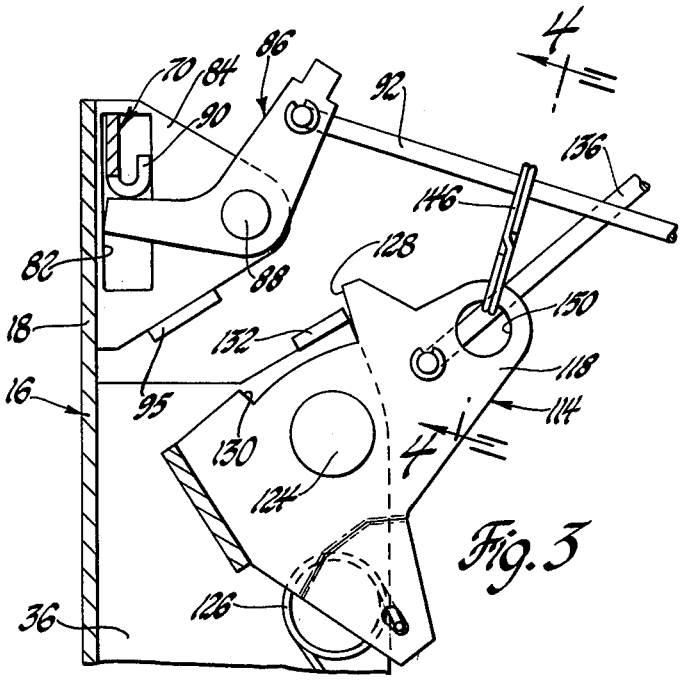
FIG. 3 is similar to FIG. 2 but showing the closure latch moved to its unlocked condition by actuation of an inside remote handle.
Figure 4:
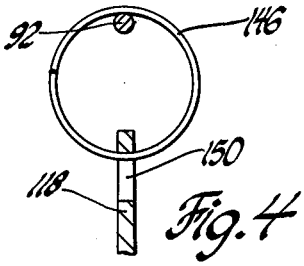
FIG. 4 is a sectional view taken in the direction of arrows 3—3 of FIG. 3.

As best seen in FIGS. 2 and 4, a ring 146 is engaged through an aperture 150 of the locking lever 114 and encircles the rod 92 connecting lever 86 with inside remote handle 94. The ring 146 is preferably of the split-type so that it can be easily assembled. The rod 92 is bent so that its portion slidably engaging the ring 146 is inclined at an angle relative the horizontal. Accordingly, as best seen by comparing FIGS. 2 and 3, actuation of the inside remote handle 94 translates the rod 92 in the rightward direction as viewed in FIGS. 2 and 3 causing the ring 146 to slide vertically up the rod 92 and thereby move the locking lever 114 to its unlocked position of FIGS. 3 and 5 wherein intermittent lever 106 is swung clockwise so that tab 110 will engage with detent arm 140. Accordingly, actuation of the inside remote handle 94 unlocks the door lock and unlatches the lock bolt. Accordingly, it will be appreciated that the addition of a ring to interconnect the locking lever and the inside remote handle connecting rod 92 will allow the opening of the vehicle door by merely pulling the inside remote handle 94 rather than requiring a separate and sequential lifting of the door lock button 138 and then operation of the inside remote handle 94.

The embodiments of the invention in which an exclusive property or privilege is claimed are defined as follows:

1. A closure latch comprising in combination, a bolt movable between latched and unlatched positions, detent means for maintaining the bolt in the latched position, outside operating means, locking means incuding a locking lever for selectively coupling and uncoupling the outside operating means and the detent means, an inside operator, means coupling the inside operator to the outside operating means, and means interconnecting the inside operator and the locking means for operating the locking means to selectively couple the inside operator to the detent means upon operation of the inside operator.

2. A closure latch comprising in combination, a bolt movable between latched and unlatched positions, detent means for maintaining the bolt in the latched position, an operating lever, outside operating means actuable to operate the operating lever, an inside remote handle, a rod interconnecting the inside remote handle and the operating lever, locking means including a locking lever for selectively coupling and uncoupling the operating lever and the detent means, and means interconnecting the rod and the locking lever so that actuation of the inside remote handle sequentially operates the locking lever to couple the operating lever and detent and then operates the operating lever to move the detent means to a position releasing the bolt to the unlatched position.

3. A closure latch and lock therefor comprising in in combination, a bolt movable between latched and unlatched positions, detent means having a detenting position maintaining the bolt in the latched position and movable to an undetenting position permitting movement of the bolt to the unlatched position, an operating lever, an intermittent lever actuatable by the operating lever and movable between a position coupling the operating lever to the detent means and an uncoupling position uncoupling the operating lever from the detent, a locking lever operable to shift the intermittent lever between coupling and uncoupling positions, an inside remote handle, a rod interconnecting the inside remote handle and the operating lever for operating the operating lever upon actuation of the inside remote handle, a ring member connected to the locking lever and slidably engaging the rod whereby initiation of actuation of the inside remote handle translates the rod and operates the locking lever to couple the intermittent lever to the detent means so that the continued actuation of the inside remote handle operates the operating lever to move the detent means to its undetenting position releasing the bolt to the unreleased position.

* * * * *